US006919857B2

(12) United States Patent
Shamblin et al.

(10) Patent No.: US 6,919,857 B2
(45) Date of Patent: Jul. 19, 2005

(54) DIFFERENTIAL MODE CAPACITIVELY LOADED MAGNETIC DIPOLE ANTENNA

(75) Inventors: Jeff Shamblin, San Marcos, CA (US); Laurent Desclos, San Diego, CA (US); Gregory Poilasne, San Diego, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 94 days.

(21) Appl. No.: 10/352,354

(22) Filed: Jan. 27, 2003

(65) Prior Publication Data

US 2004/0145523 A1 Jul. 29, 2004

(51) Int. Cl.[7] ..... H01Q 9/28
(52) U.S. Cl. ..... 343/795; 343/804; 343/744
(58) Field of Search ..... 343/700 MS, 744, 343/795, 804, 895

(56) References Cited

U.S. PATENT DOCUMENTS

| | | | | |
|---|---|---|---|---|
| 3,648,172 A | | 3/1972 | Nakahara et al. | |
| 3,721,990 A | | 3/1973 | Gibson et al. | |
| 3,845,487 A | | 10/1974 | Lammers | |
| 4,328,502 A | | 5/1982 | Scharp | |
| 4,450,449 A | | 5/1984 | Jewitt | |
| 4,598,276 A | | 7/1986 | Tait | |
| 4,684,952 A | | 8/1987 | Munson et al. | |
| 4,749,996 A | | 6/1988 | Tresselt | |
| 5,184,144 A | | 2/1993 | Thombs | |
| 5,245,745 A | | 9/1993 | Jensen et al. | |
| 5,309,164 A | | 5/1994 | Dienes et al. | |
| 5,313,218 A | * | 5/1994 | Busking | 343/727 |
| 5,337,065 A | | 8/1994 | Bonnet et al. | |

(Continued)

FOREIGN PATENT DOCUMENTS

| | | |
|---|---|---|
| EP | 0 604 338 A | 6/1994 |
| EP | 0 942 488 A | 9/1999 |
| EP | 1 067 627 A | 1/2001 |
| JP | 56 012102 | 2/1981 |
| JP | 09 055621 A | 2/1997 |
| JP | 2000 031735 A | 1/2000 |
| JP | 2000 068736 A | 3/2000 |

OTHER PUBLICATIONS

Wheeler, "Small Antennas." IEEE Transactions on Antennas and Propagation, 462–468, Jul. 1975.

Sievenpiper et al., "High impedance electromagnetic surfaces with a forbidden frequency band." IEEE Transactions on Microwave Theory and Techniques, 47(11): 2059–2074, 1999.

*Primary Examiner*—Shih-Chao Chen
(74) *Attorney, Agent, or Firm*—G. Peter Albert, Jr.; Foley & Lardner LLP

(57) ABSTRACT

Differential mode capacitively loaded magnetic dipole designs are provided for usage in various applications. Impedance matching may be accomplished with changes to antenna structures without concomitant changes in resonant frequency.

23 Claims, 9 Drawing Sheets

U.S. PATENT DOCUMENTS 5,410,323 A 4/1995 Kuroda
5,450,090 A 9/1995 Gels et al.
5,627,550 A 5/1997 Sanad
5,726,666 A 3/1998 Hoover et al.
5,754,143 A 5/1998 Warnagiris et al.
5,764,190 A 6/1998 Murch et al.
5,781,158 A 7/1998 Ko et al.
5,790,080 A 8/1998 Apostolos
5,835,063 A 11/1998 Brachat et al.
5,900,843 A 5/1999 Lee
5,936,583 A 8/1999 Sekine et al.
5,943,020 A 8/1999 Liebendoerfer et al.
5,966,096 A 10/1999 Brachat
5,986,606 A 11/1999 Kossiavas et al.
6,002,367 A 12/1999 Engblom et al.
6,008,762 A 12/1999 Nghiem
6,008,764 A 12/1999 Ollikainen et al.
6,046,707 A 4/2000 Gaughan et al.
6,114,996 A 9/2000 Nghiem
6,133,880 A 10/2000 Grangeat et al.
6,140,965 A 10/2000 Van Hoozen
6,140,969 A 10/2000 Lindenmeier et al.
6,147,649 A 11/2000 Ivrissimtzis et al.
6,157,348 A 12/2000 Openlander
6,181,281 B1 1/2001 Desclos et al.
6,195,051 B1 2/2001 McCoy et al.
6,211,825 B1 4/2001 Deng
6,246,371 B1 6/2001 Kurz et al.
6,295,028 B1 9/2001 Jonsson et al.
6,304,222 B1 10/2001 Smith et al.
6,323,810 B1 11/2001 Poilasne et al.
6,339,409 B1 1/2002 Warnagiris
6,348,894 B1 2/2002 Lahti
6,369,777 B1 4/2002 Ohara et al.
6,381,471 B1 4/2002 Dvorkin
6,404,392 B1 6/2002 Blom

* cited by examiner

*Side-View*

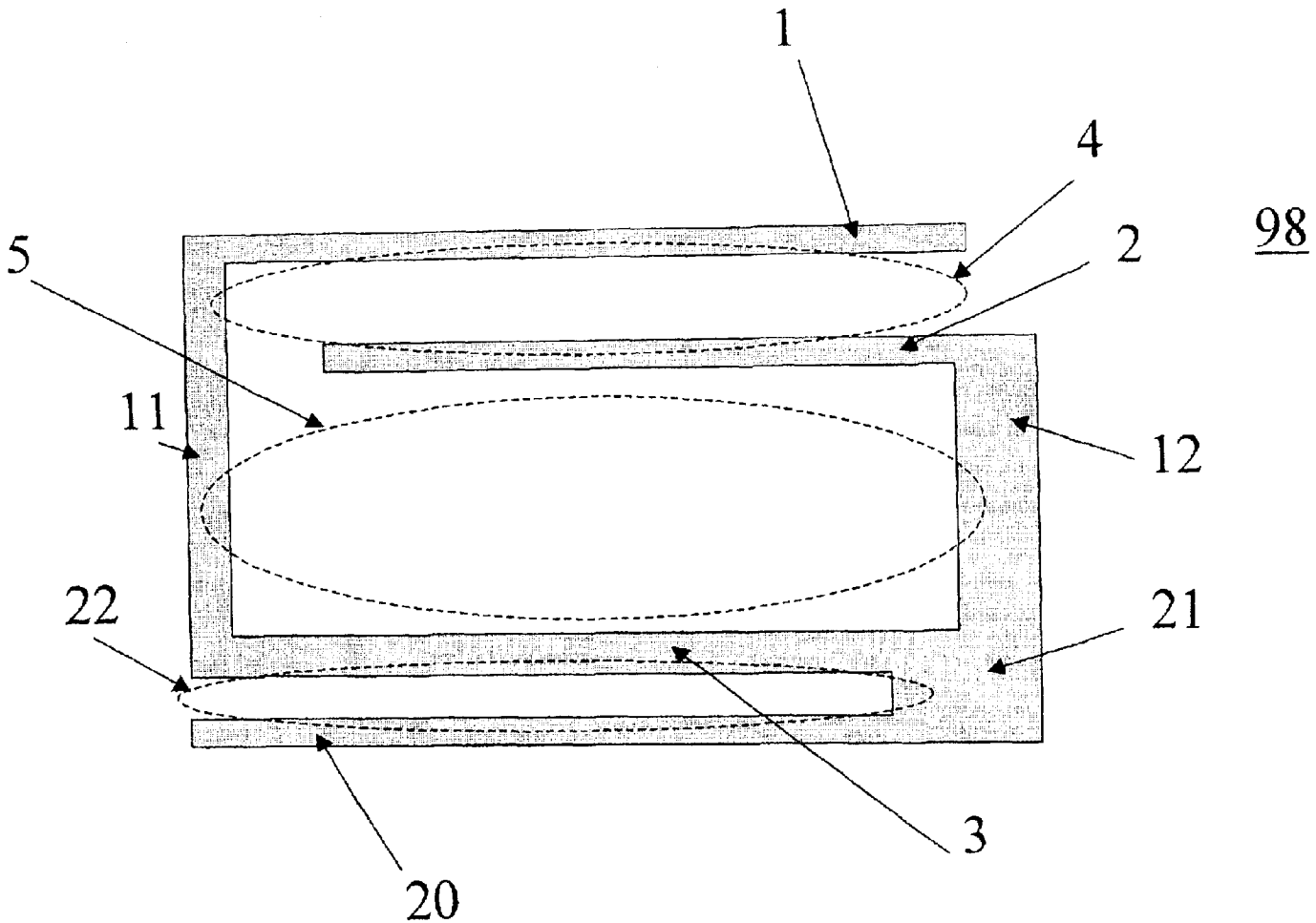
-Fig.2a -

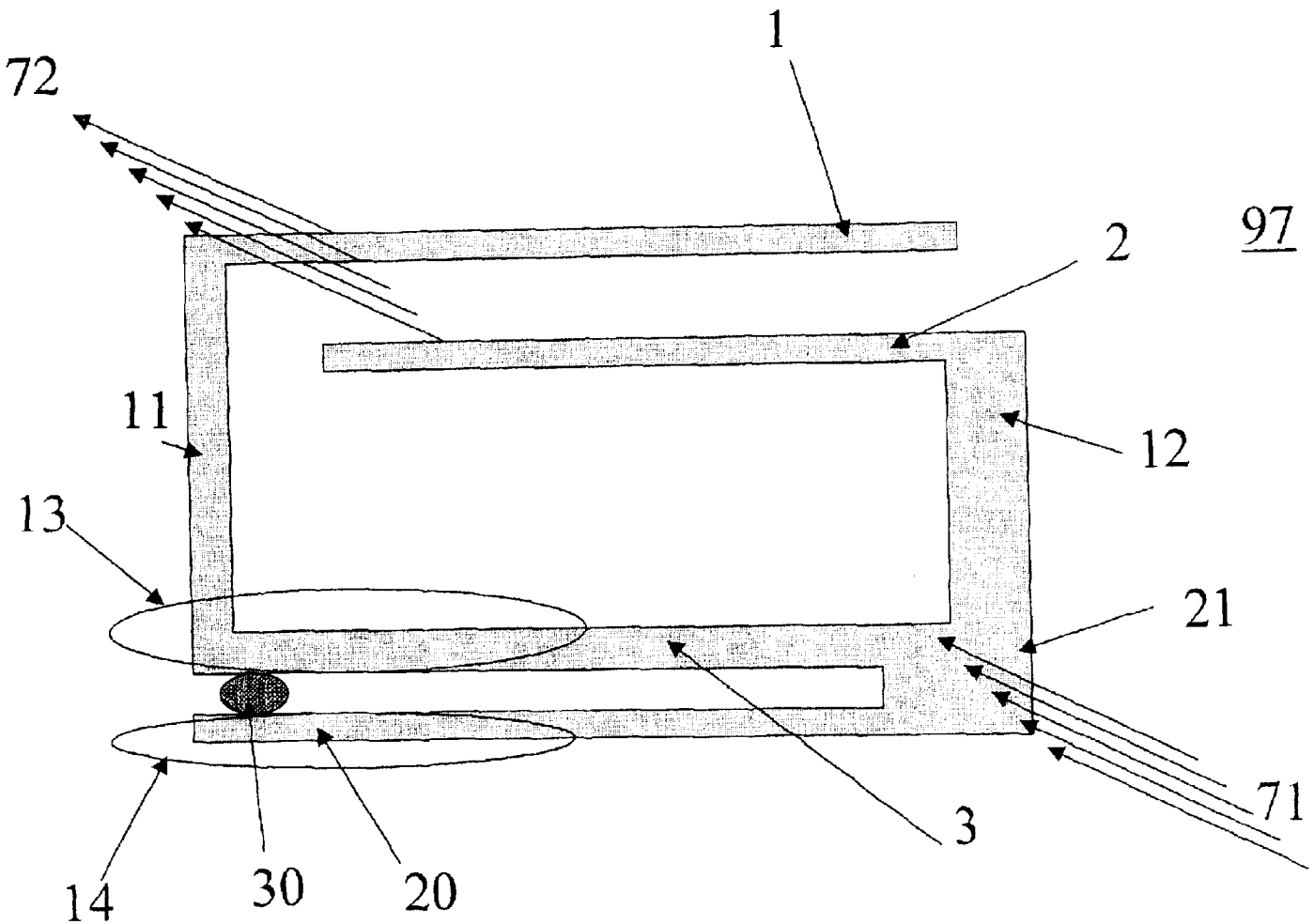
-Fig.3-

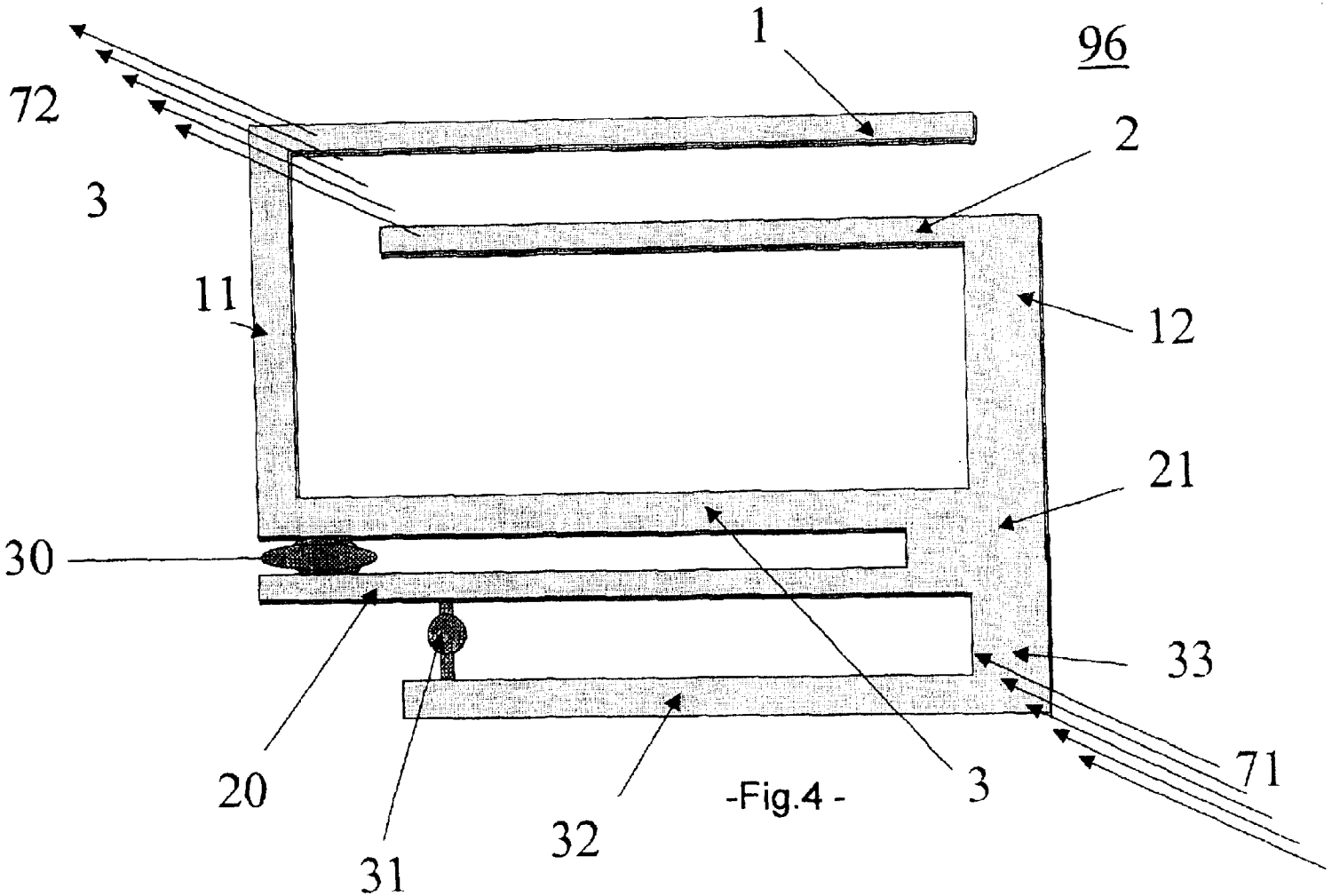
-Fig.4-

DIFFERENTIAL MODE CAPACITIVELY LOADED MAGNETIC DIPOLE ANTENNA

CROSS-REFERENCE TO RELATED APPLICATIONS

This application is related to commonly assigned U.S. Pat. No. 6,456,243, filed on 26 Jun. 2001, which is incorporated herein by reference.

This applications is related to commonly assigned U.S. Pat. No. 6,323,810, filed on 6 Mar. 2001, which is incorporated herein by reference.

This Application is related to commonly assigned U.S. patent application Ser. No. 10/298,870, filed on 18 Nov. 2002, which is incorporated herein by reference.

This Application is related to commonly assigned U.S. patent application Ser. No. 10/328,799, 24 Dec. 2002, which is incorporated herein by reference.

FIELD OF THE INVENTION

The present invention relates generally to the field of antennas, and more particularly to the design of differential mode capacitively loaded magnetic dipole antennas.

BACKGROUND

For an antenna to function in a particular environment it may be necessary that the antenna impedance be matched to the environment. For two different environments, an antenna design may need to be flexible enough to permit antenna impedance to be changed. However, in the prior art, changing antenna impedance invariably impacts an antenna's resonant frequency. The present invention improves over prior art antenna designs.

SUMMARY OF THE INVENTION

The present invention includes one or more differential mode capacitively loaded magnetic dipole antenna design and method of use.

In one embodiment, a device comprises an antenna, the antenna defined by a plurality of portions, wherein one or more of the plurality of portions are coupled in a first geometrical relationship that effectuates one or more antenna frequency, and wherein one or more of the plurality of portions are coupled in a second geometrical relationship that effectuates one or more antenna impedance, wherein a change in the first geometrical relationship effectuates a change in the one or more antenna frequency, wherein a change in the second geometrical relationship effectuates a change in the one or more antenna impedance, and wherein a change of the one or more antenna frequency or the one or more antenna impedance may be effectuated without a corresponding change in the one or more antenna impedance or the one or more antenna frequency. One or more of the portions may comprise a circuit. In one embodiment, an article may comprise a plurality of portions, wherein one or more of the plurality of portions are coupled to define a differential mode capacitively coupled dipole antenna. One or more of the plurality of portions may be coupled to define one or more radiative portion, and one or more of the plurality of portions may be coupled to define one or more impedance matching portion. One or more of the plurality of portions may be coupled in a first geometrical relationship that effectuates one or more antenna frequency, wherein one or more of the plurality of portions are coupled in a second geometrical relationship that effectuates one or more antenna impedance. A change in the first geometrical relationship may effectuate a change in the one or more antenna frequency, wherein a change in the second geometrical relationship effectuates a change in the one or more antenna impedance, and wherein a change of the one or more antenna frequency or the one or more antenna impedance may be effectuated without a respective corresponding change in the one or more antenna impedance or the one or more antenna frequency. One or more of the portions may comprise a circuit. One or more of the portions may comprise a rectifier circuit. One or more of the portions may comprise a coding circuit. A circuit may be coupled to a radiative portion and to an impedance matching portion. A circuit may be coupled to one or more impedance matching portion. One or more of the portions may comprise a circuit, wherein each circuit comprises a different code.

In one embodiment, a method of using a capacitively coupled dipole antenna may comprise the steps of: placing the antenna in a radiative field; exciting the antenna with the radiative field to provide a signal at a resonant frequency; and detecting the signal. The method may further comprise the step of providing the signal at one of a plurality of antenna impedances. The method may further comprise the step of providing elements of the antenna in a geometrical relationship; and changing a geometrical relationship between some of the elements to change an impedance of the antenna. The method may further comprise the step of changing the impedance of the antenna independent of the resonant frequency.

In one embodiment, a method of using an antenna in an environment may comprise the steps of: placing the antenna in one or more radiative field; exciting the antenna to provide one or more signal at a resonant frequency, wherein each signal corresponds to a particular radiative field. The method may further comprise the step of providing elements of the antenna in a geometrical relationship; and changing a geometrical relationship between some of the elements to change an impedance of the antenna. The method may further comprise the step of providing the signals at one of a plurality of antenna impedances. The method may further comprise the step of changing the impedance of the antenna independent of antenna resonant frequency.

In one embodiment, a method of using an antenna with an article may comprise the steps of: coupling the antenna to the article; providing the antenna with one or more impedance matching portion to match an impedance of the antenna to an impedance of the article; placing the article in a radiative field; using the radiative field to excite the antenna to radiate a signal at a resonant frequency; and detecting the signal. The method may further comprise the step of providing elements of the antenna in a geometrical relationship that defines a capacitively loaded magnetic dipole antenna. The method may further comprise the step of changing a geometrical relationship between some of the elements to change an impedance of the antenna. The method may further comprise the step of changing the impedance of the antenna independent of the resonant frequency. In one embodiment, the article may comprise a paper roll.

In one embodiment, an antenna may comprise: resonant frequency means for providing one or more antenna resonant frequency; and antenna impedance matching means for providing one or more antenna impedance.

Other embodiments are contemplated and should be limited only by the claims.

BRIEF DESCRIPTION OF THE DRAWINGS

FIG. 2A illustrates a side view of an embodiment of a differential mode capacitively loaded magnetic dipole antenna.

FIG. 3 illustrates a side view of an embodiment of a differential mode capacitively loaded magnetic dipole antenna.

FIG. 4 illustrates a side view of an embodiment of a differential mode capacitively loaded magnetic dipole antenna.

DETAILED DESCRIPTION OF THE INVENTION

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

Figure 1A:
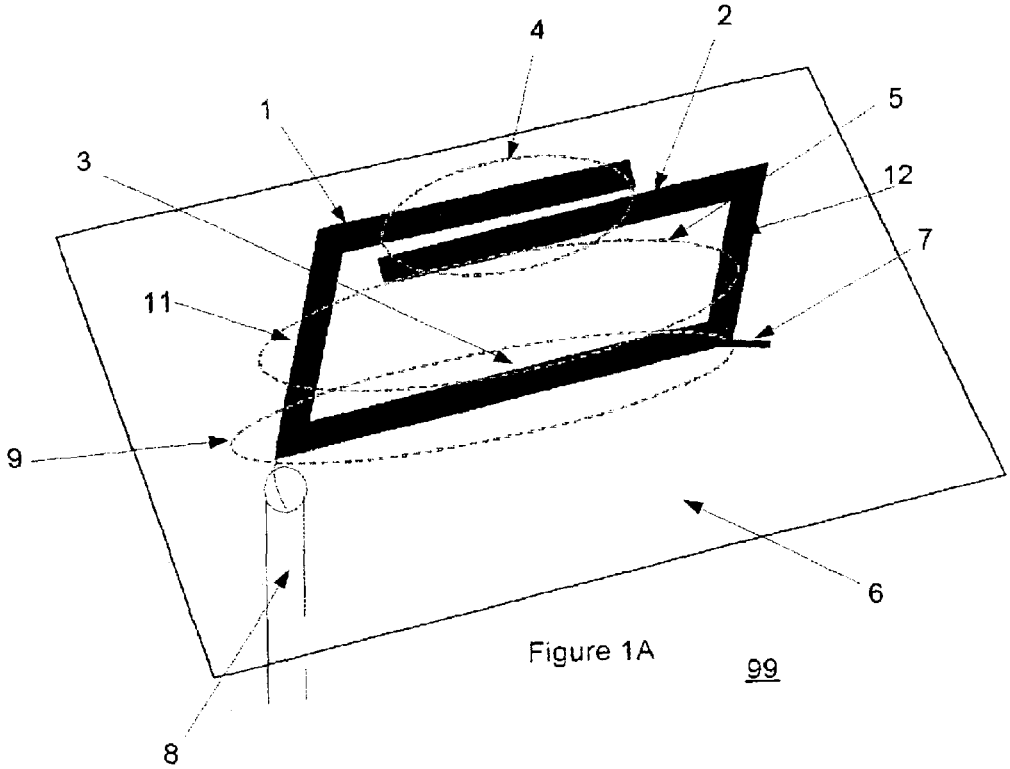
FIGS. 1A and 1B illustrate respective three-dimensional and side views of an embodiment of a capacitively loaded magnetic dipole antenna.
Figure 1B:
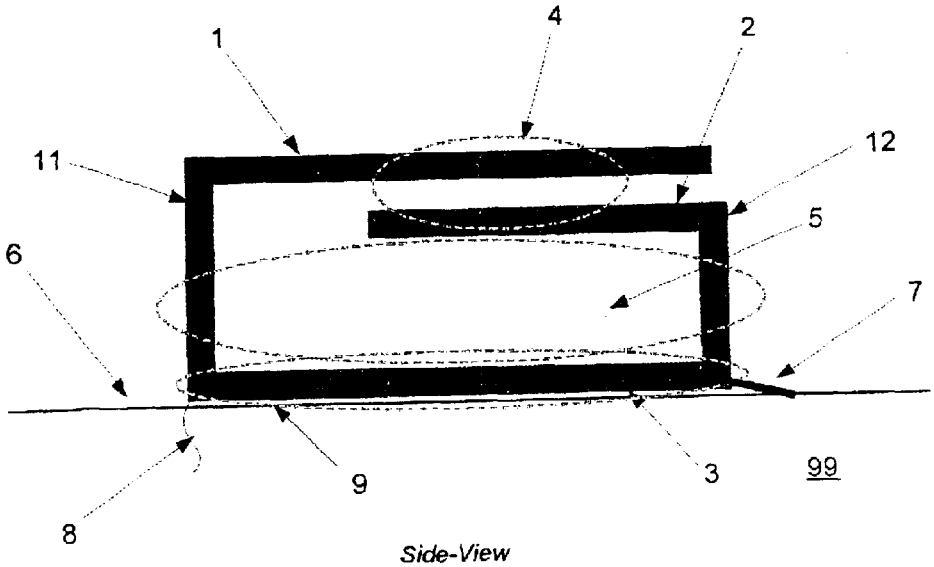

FIGS. 1A and 1B illustrate respective three-dimensional and side views of an embodiment of a capacitively loaded magnetic dipole antenna (99). In one embodiment, antenna (99) comprises a top (1), a middle (2), and a first lower (3) portion. In one embodiment, the top portion (1) is coupled to the first lower portion (3) by a first coupling portion (11), and the first lower portion (3) is coupled to middle portion (2) by a second coupling portion (12). In one embodiment, antenna (99) comprises a feed area, generally indicated as feed area (9), whereat input or output signals are provided by a feedline (8). In one embodiment, the first coupling portion (11) and the second coupling portion (12) are disposed relative to each other in a generally parallel relationship. In one embodiment, top portion (1), middle portion (2), and first lower portion (3) are disposed relative to each other in a generally parallel relationship. In one embodiment, portions (1), (2), and (3) are disposed relative to portions (11) and (12) in a generally orthogonal relationship. For example, in the embodiment of FIGS. 1A-B, portions (1), (2), (3), (11), and (12) are disposed in a generally orthogonal or parallel relationship relative to a grounding plane (6). It is understood, however, that the present invention is not limited to the described embodiments, as in other embodiments portions (1), (2), (3), (11), and (12) may be disposed relative to each other in other geometrical relationships and with other geometries. For example, top portion (1) may be coupled to first lower portion (3), and first lower portion (3) may be coupled to middle portion (2), by respective coupling portions (11) and (12) such that one or more of the portions are disposed relative to each other in generally non-parallel and/or non-orthogonal relationships. In one embodiment, portions (1), (2), (3), (11), and (12) comprise are shaped to comprise flat plate structures, wherein a flat geometry of each portion (1), (2), (3) is disposed in a plane generally parallel to the grounding plane (6), and wherein a flat geometry of each portion (11) and (12) is disposed in a plane generally perpendicular to grounding plane (6). In one embodiment, portions (1), (2), (3), (11), and (12) may comprise conductors. The conductors may be flexible or rigid.

In one embodiment, first lower portion (3) is disposed above and electrically isolated from grounding plane (6). First lower portion (3) is coupled to grounding plane (6) at a grounding point (7). It is identified that antenna (99) may be modeled as a radiative resonant LC circuit with a capacitance (C) that corresponds to a fringing capacitance that exists across a first gap bounded generally by top portion (1) and middle portion (2), indicated generally as area (4), and with an inductance (L) that corresponds to an inductance that exists in a second gap bounded by the middle portion (2) and first lower portion (3), indicated generally as area (5).

The geometrical relationship between portions (1), (2), (3), (11), (12) and the gaps formed thereby may be used to effectuate an operating frequency about which the antenna (99) resonates and radiates a signal.

FIG. 2A illustrates a side view of an embodiment of a differential mode capacitively loaded magnetic dipole antenna (98). In one embodiment, antenna (98) includes one or more portions (1), (2), (3), (11), and (12) as is referenced by FIGS. 1A-B, and further comprises a first bottom portion (20). In one embodiment, the first bottom portion (20) is coupled to first lower portion (3) by a third coupling portion (21). In one embodiment, the third coupling portion (21) and the first coupling portion (11) are disposed relative to each other in a generally parallel relationship, and the first bottom portion (20) and the first lower portion (3) are disposed relative to each other in a generally parallel relationship. In one embodiment, first bottom portion (20) is disposed in a generally orthogonal relationship relative to third coupling portion (21). It is understood, however, that the present invention is not limited to the described embodiments, as in other embodiments the portions (1), (2), (3), (11), (12), (20) and (21) may be disposed and coupled relative to each other in other geometrical relationships to comprise other geometries. For example, first bottom portion (20) may be coupled by third coupling portion (21) to first lower portion (3) such that one or more of the portions are disposed in a generally non-parallel and/or non-orthogonal relationship relative to each other. In one embodiment, portions (1), (2), (3), (11), (12), (20), and (21) comprise conductors. The conductors may comprise rigid or flexible structures. In other embodiments, portions (1), (2), (3), (11), (12), (20), and (21) may comprise cylindrical, curved, or other geometries. In one embodiment, portions (1), (2), (3), (11), (12), (20), and (21) may comprise flat surfaces. In one embodiment, flat surface portions (1), (2), (3), (11), (12), (20), and (21) are disposed relative to each other generally in the same plane plane. In one embodiment, flat surfaces of portions (1), (2), (3), (11), (12), (20), and (21) are disposed relative to each other in planes that are generally parallel to each other. In one embodiment, flat surfaces of portions (11), (12), (21) are disposed generally orthogonal to flat surfaces of portions (1), (2), (3), (20).

It is identified that antenna (98) may be modeled as a radiative resonant LC circuit with a capacitance (C) that corresponds to a fringing capacitance that exists across a first gap bounded generally by top portion (1) and middle portion (2), indicated generally as area (4), and with an inductance (L) that corresponds to an inductance that exists in a second gap bounded by the middle portion (2) and first lower portion (3), indicated generally as area (5). Thus, it is identified that a particular geometrical relationship between the portions (1), (2), (3), (11), (12), and the gaps formed thereby, may be used to effectuate a particular operating frequency at which antenna (98) radiates a signal. It is further identified that the selection of the particular geometrical relationship is within the scope of those skilled in the art.

In one embodiment, bottom portion (20) and first lower portion (3) bound a third gap indicated generally as area (22). It is identified that a particular geometrical relationship between portions (3), (20), and (21), and the gap formed thereby, may be used to effectuate a particular antenna (98) impedance, it is further identified that the selection of the particular geometrical relationship is within the scope of those skilled in the art.

Figure 2B:
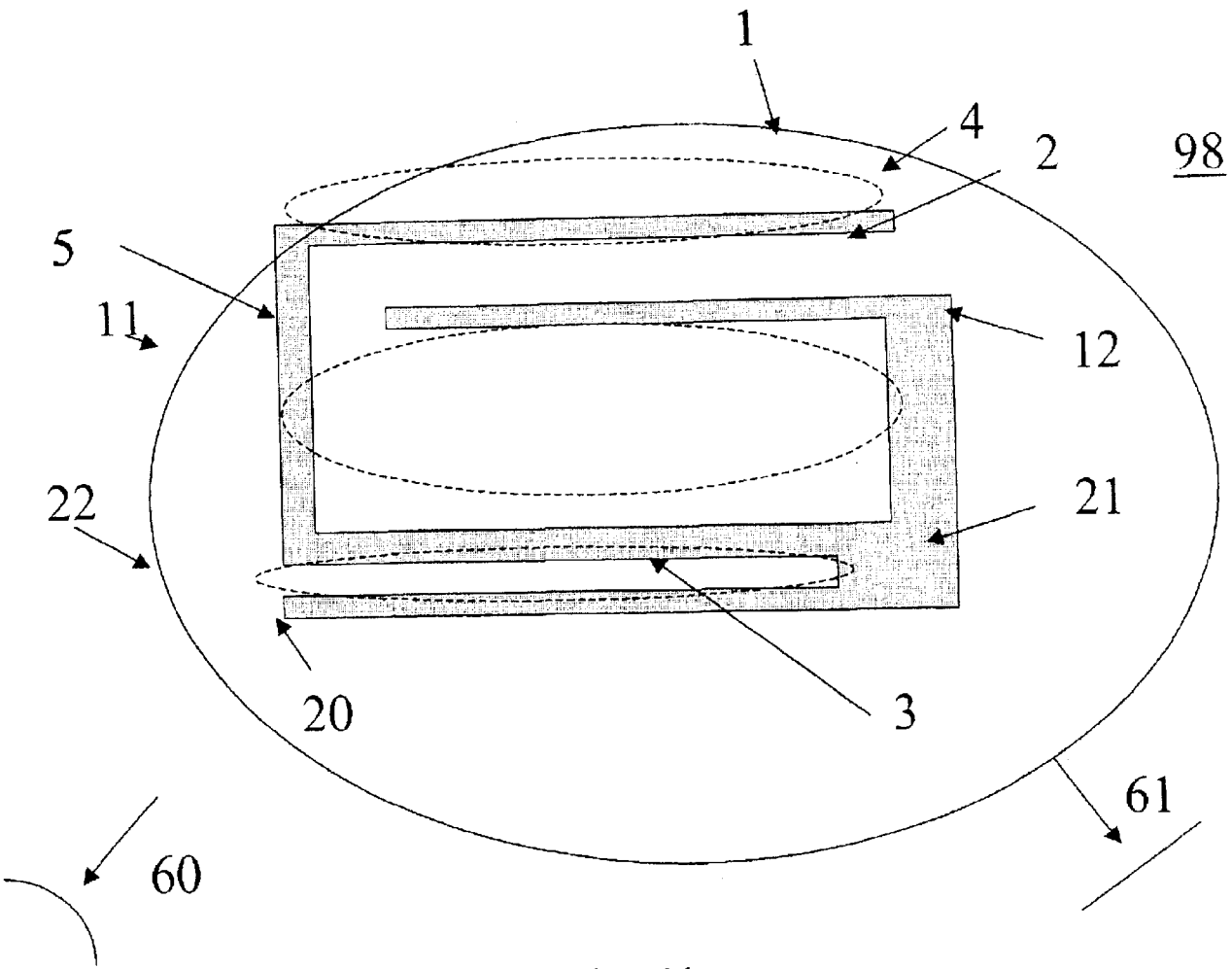
FIG. 2B illustrates views of embodiments of a differential mode capacitively loaded magnetic dipole antenna.

FIG. 2B illustrates two top view representations of embodiments of a differential mode capacitively loaded magnetic dipole antenna, wherein as seen in a top view of one embodiment, portions (1), (2), (3), (11), (12), (20), and (21) are coupled to define a geometrically flat antenna (61), and wherein as seen in a top view of a second embodiment, portions (1), (2), (3), (11), (12), (20), and (21) are coupled to define a geometrically curved antenna (60). Thus, it is understood that the portions of antenna (98), as well as the portions of other antennas described herein, may be coupled to comprise other geometries and other geometric structures and yet remain within the scope of the present invention.

FIG. 3 illustrates a side view of an embodiment of a differential mode capacitively loaded magnetic dipole antenna (97). It is identified that antenna (97) may be used in a differential mode, wherein one differential connection is made to a radiative portion of antenna (97), and wherein a second differential connection is made to an impedance matching portion of antenna (97). In one embodiment, one differential connection is made to first lower portion (3) and a second differential connection is made to bottom portion (20). In one embodiment, one differential connection is made in a fourth area (13) that generally bounds first lower portion (3) and a second differential connection is made in a fifth area (14) that generally bounds bottom portion (20). In one embodiment, antenna (97) includes previously referenced portions (1), (2), (3), (11), (12), (20) and (21), and further comprises a first device portion (30). In one embodiment, first device portion (30) is coupled at one end to first bottom portion (20) in the fifth area (14) and at another end to first lower portion (3) in the fourth area (13).

It is identified that when antenna (97) is placed in a radiative field (71) comprising a particular frequency that is in the resonant operating frequency band of antenna (97), the antenna may begin to radiate a signal (72) centered about at its resonant frequency. In one embodiment, first device portion (30) may comprise a rectifier circuit. In one embodiment, first device portion (30) may comprise a transmission circuit, wherein a current flow created in the antenna (97) at its resonant frequency may be used by the rectifier circuit to energize the transmission circuit. In one embodiment, first device portion (30) may comprise a first code emission circuit, the first code emission circuit for providing a code. In one embodiment, the code may comprise information superimposed onto signal (72). In one embodiment the code is a simple binary code, although it is understood that other codes and other code protocols are within the scope of the invention. The code may represent identification information or other information, for example, information received by a transducer circuit coupled to first device portion (30). It is identified that information may be thus provided by signal (72) to identify the presence of the radiative (71) field in the vicinity of the antenna (97), the presence of the antenna (97) within the radiative field, or the code or other information provided by first device portion (30). It is further identified that design and implementation of a transmission, rectifier, and code circuit, as identified herein, may be effectuated by those skilled in the art.

In one embodiment, multiple antennas (97) may be provided, each comprising a first device portion (30) and code emission circuit, each code emission circuit comprising a unique code. For example, a,first antenna may comprise a code emission circuit with a code "101" and second antenna may comprise a code "111". It is identified that the presence of the first or second antenna within an appropriate radiative field (71) may be thus identified by detection of a respective code "101" or "111".

FIG. 4 illustrates a side view of an embodiment of a differential mode capacitively loaded magnetic dipole antenna (96). In one embodiment, antenna (96) includes previously referenced portions (1), (2), (3), (11), (12), (20), (21), (30), and further comprises a second bottom portion (32), a fourth coupling portion (33), and a second device portion (31), all coupled and geometrically disposed in accordance with previously disclosed principles. In one embodiment, second device portion (30) is coupled at one end to the third bottom portion (32) and at another end to the second portion (20).

It is identified that when antenna (96) is placed in a radiative field (71) comprising a particular frequency that is in the resonant operating frequency band of antenna (96), the antenna may begin to radiate a signal (72) at its resonant frequency. In one embodiment, first device portion (30) and second device portion (31) may each comprise a rectifier circuit. In one embodiment, first device portion (30) and second device portion (31) may each comprise a transmission circuit, wherein a current flow created in the antenna (96) at its resonant frequency may be used by the rectifier circuits to energize the transmission circuits. In one embodiment, first device portion (30) and second device portion (31) may comprise a respective first and second code emission circuit, each providing a code. In one embodiment, the code may comprise information superimposed onto signal (72). In one embodiment the code is a simple binary code, although it is understood that other codes and other code protocols are within the scope of the invention. The code may represent identification information or other information.

In one embodiment, first device portion (30) may comprise a first unique code "101" and a second device portion (31) may comprise a second unique code "111". It is identified that the presence of an antenna and/or an item coupled to the antenna within an appropriate radiative field may be identified by detection of the first or second code, which would be useful for detecting the presence of an antenna (96) by different code detection apparatus capable of detecting only a code "101" or "111".

It is identified that for efficient transmission of signal (72), a particular antenna impedance may be desired so as to match the antenna impedance to the impedance of a particular environment. An embodiment wherein multiple device portions are used, for example (30) and (31) as described herein, may be used to effectuate impedance matching in different environments. Multiple particular antenna impedances may be effectuated by providing a particular geometrical relationship between portions (3), (20), (21), (32), and (33). It is identified that changes to the geometrical relationship between portions (3), (20), (21), (32), and (33) may be made without affecting the resonant frequency of antenna (96). Providing a particular geometrical relationship between portions (3), (20), (21), (32), and (33) is within the scope of those skilled in the art.

Figure 5:
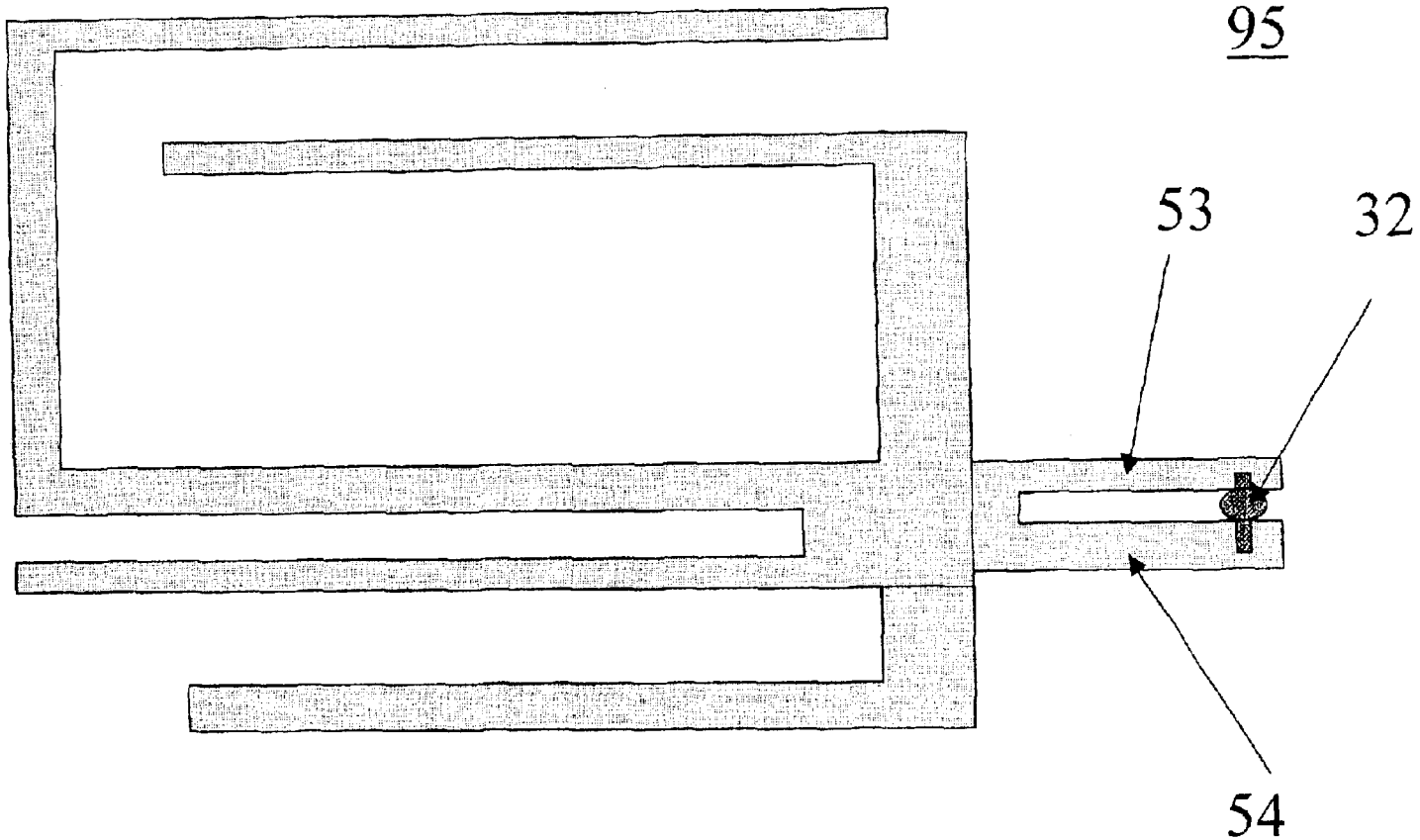
FIG. 5 illustrates an embodiment wherein additional portions (32), (53), and (54) are coupled to a differential mode capacitively loaded magnetic dipole antenna.

FIG. 5 illustrates an embodiment wherein additional portions (32), (53), and (54) are coupled to an antenna to provide additional antenna impedance matching flexibility in accordance with principles described herein.

Figure 6:
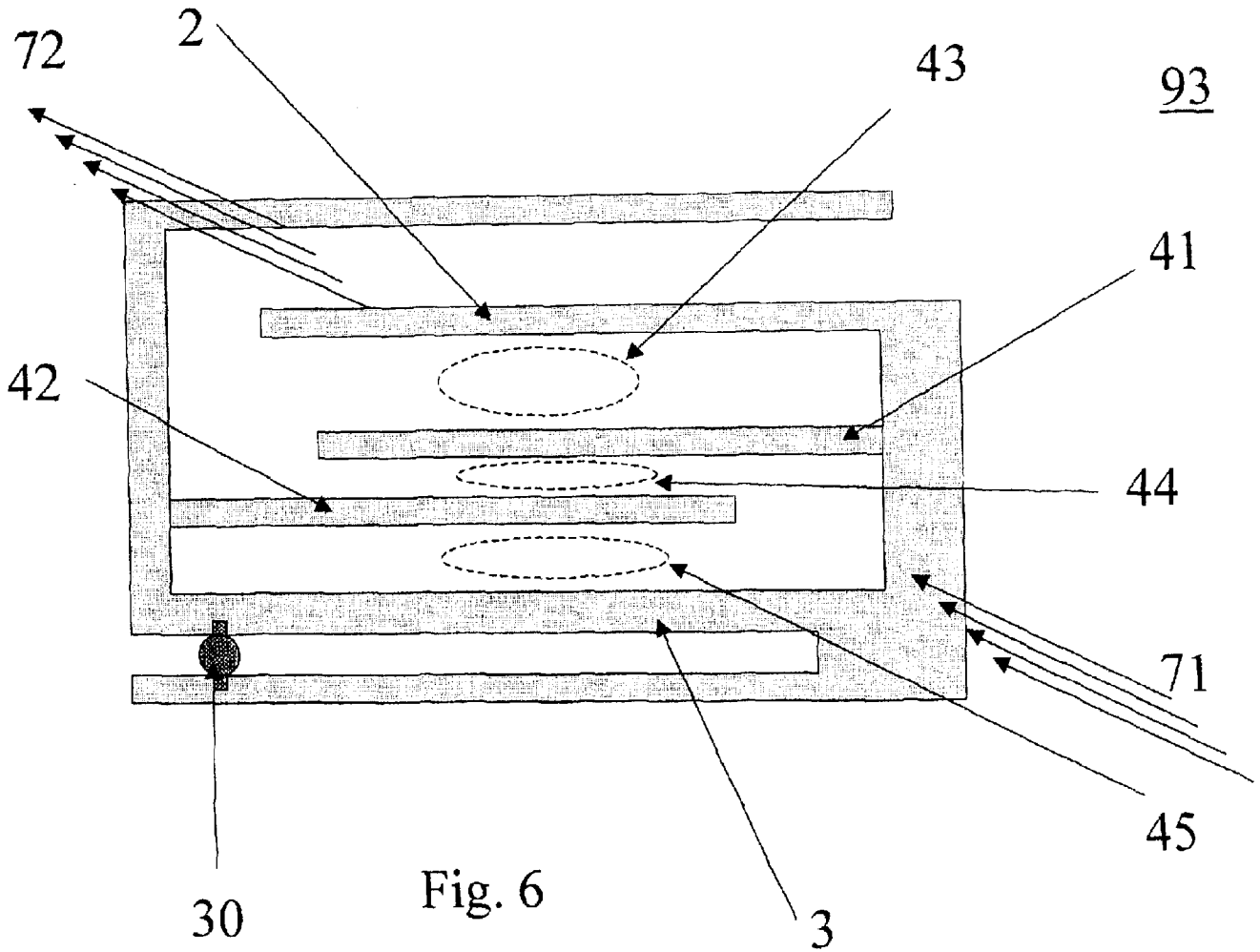
FIG. 6 illustrates a side view of an embodiment of a differential mode capacitively loaded magnetic dipole antenna.

FIG. 6 illustrates a side view of an embodiment of a differential mode capacitively loaded magnetic dipole antenna (93). In one embodiment, antenna (93) includes previously referenced portions (1), (2), (3), (11), (12), (20), (21), (30), and further comprises one or more lower portion disposed between middle portion (2) and first lower portion (3). In one embodiment, antenna (93) comprises a second lower portion (41) and a third tower portion (42), both coupled and geometrically disposed in accordance with principles disclosed herein previously. In one embodiment, second lower portion (41) and middle portion (2) bound an area (43) to define a sixth gap, second lower portion (41) and third lower portion (42) bound an area (44) to define a seventh gap, and third lower portion (42) and first lower portion (3) define an eighth gap. It is identified that by coupling one or more additional portion within a radiative part of a capacitively loaded magnetic dipole, the geometrical relationships between the portions, and the additional gaps thus formed, may be used to effectuate creation of multiple antenna resonant frequencies. It is identified that in an embodiment, wherein an antenna (93) comprises multiple resonant frequencies, a particular signal (71) may be used to excite the antenna to radiate a signal (72) at a particular one of its resonant frequencies.

In one embodiment, first device portion (30) may comprise a rectifier circuit. In one embodiment, first device portion (30) may comprise a transmission circuit, wherein a current flow created in the antenna (93) at its resonant frequency may be used by the rectifier circuit to energize the transmission circuit. In one embodiment, first device portion (30) may comprise a first code emission circuit, the first code emission circuit for providing a code. In one embodiment, the code may comprise information superimposed onto signal (72). In one embodiment the code is a simple binary code, although it is understood that other codes and other code protocols are within the scope of the invention. The code may represent identification information or other information, for example, information received by a transducer circuit coupled to first device portion (30). It is identified that information may be thus provided by signal (72) to identify the presence of the radiative (71) field in the vicinity of the antenna (97), the presence of the antenna (93) within the radiative field, or the code or other information provided by first device portion (30). It is further identified that design and implementation of additional portions, a transmission, rectifier, and code circuit, as identified herein, may be effectuated by those skilled in the art.

Figure 7:
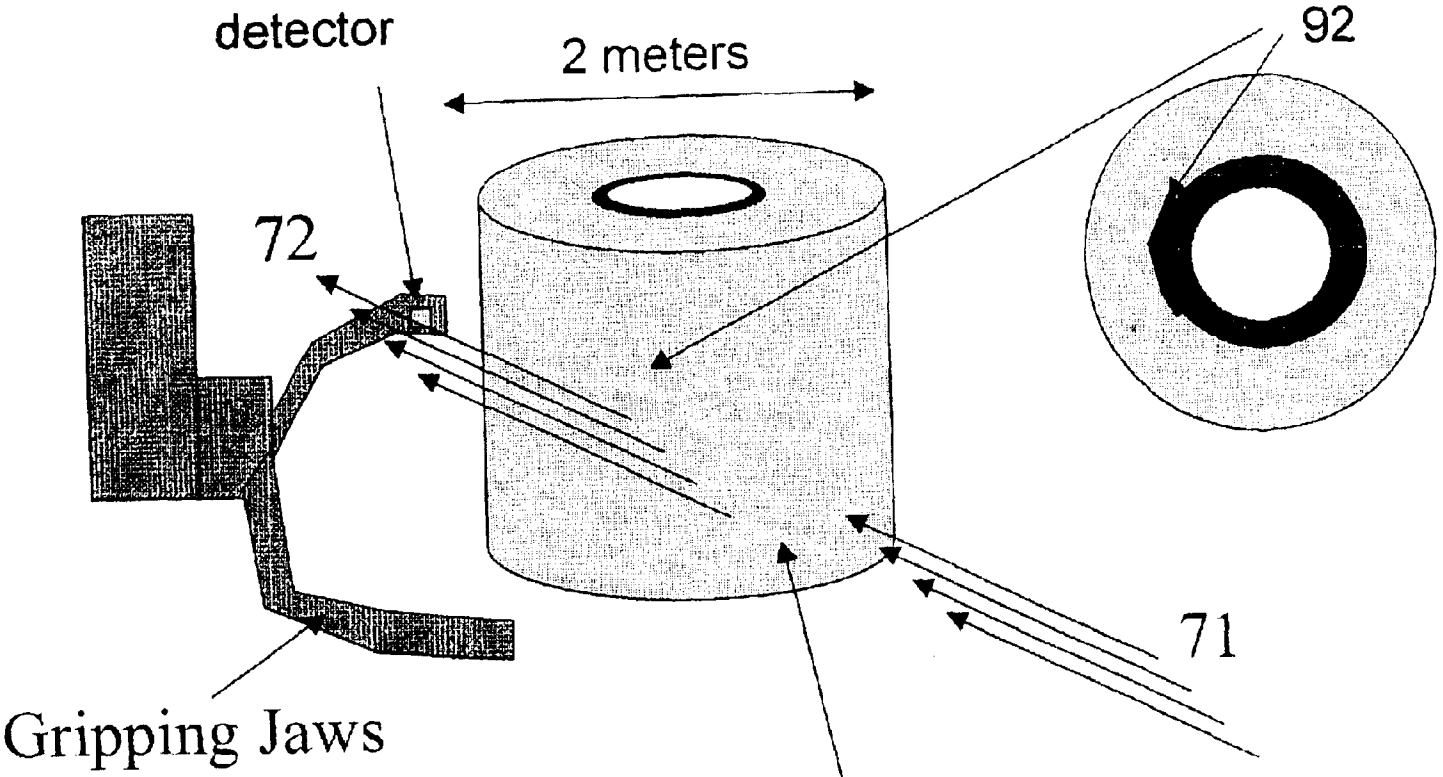
FIGS. 7 and 8 illustrate views of embodiments wherein the presence of a differential mode capacitively loaded magnetic dipole antenna is detected within a radiative field.
Figure 8:
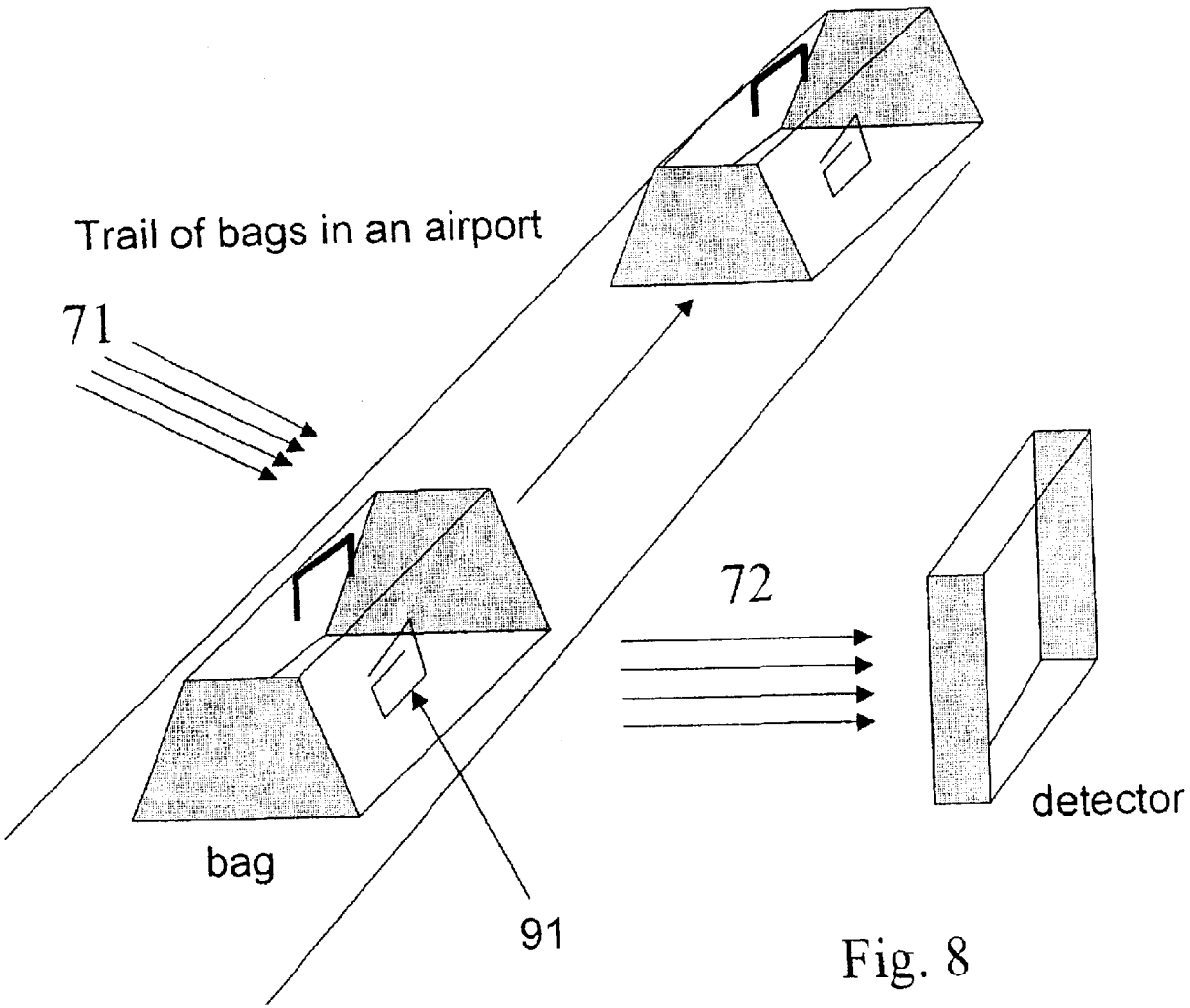

FIGS. 7 and 8 illustrate views of embodiments wherein the presence of a differential mode capacitively loaded magnetic dipole antenna is detected within a radiative field.

In one embodiment, illustrated in FIG. 8, an antenna (92) may be embedded in, coupled to, or placed in the vicinity of an article or portions thereof, for example, a paper roll (59), or some part thereof, manufactured during a paper manufacturing process. Antenna (92) may be coupled to the roll of paper, before, at the beginning, in the middle, at the end, or after the end of the manufacturing process. In accordance with the previous descriptions provided herein, by immersing the roll of paper (59) within an external radiative field (72) corresponding to a resonant frequency of the antenna (92), the antenna may be made to radiate a signal and/or code to enable tracking of the roll of paper during its manufacturing process. It is identified that for efficient radiation of a signal by antenna (92) at a particular frequency with different paper rolls, for example, paper rolls that exhibit different geometries, antenna (92) may need to be provided with different antenna impedances. It is identified that, for each roll of paper, one or more embodiment described herein may be utilized to effectuate a proper impedance match and, thus efficient transmission of a signal (72).

In one embodiment illustrated in FIG. 8, one or more antenna (91) in accordance with the descriptions previously provided herein may be embedded or coupled to articles of airport baggage to effectuate tracking of the baggage during one or more baggage processing stages. It is identified that for each bag, one or more embodiment described herein may be utilized to effectuate a proper impedance match and, thus efficient transmission of a signal (72).

Thus, it wilt be recognized that the preceding description embodies one or more invention that may be practiced in other specific forms without departing from the spirit and essential characteristics of the disclosure and that the invention is not to be limited by the foregoing illustrative details, but rather is to be defined by the appended claims.

What is claimed is:

1. A device, comprising:

an antenna configured for coupling to an article, the antenna defined by a plurality of portions, wherein one or more of the plurality of portions are radiative portion coupled in a first geometric relationship that effectuates one or more antenna frequency, and wherein one or more of the plurality of portions are impedance matching portion coupled in a second geometrical relationship that effectuates one or more antenna impedance, wherein a change in the first geometrical relationship effectuates a change in the one or more antenna frequency, wherein a change in the second geometrical relationship effectuates a change in the one or more antenna impedance the impedance the matching portion arranged in the second geometrical relationship to produce an antenna impedance to match an impedance of the article, and wherein a change of the one or more antenna frequency or the one or more antenna impedance is effectuated without a corresponding change in the one or more antenna impedance or the one or more antenna frequency.

2. The device of claim 1, wherein one or more of the portions comprises a circuit.

3. The device of claim 2, wherein the antenna comprises a differential mode capacitively coupled dipole element.

4. The device of claim 1, wherein one or more of the portions comprises a rectifier circuit.

5. The device of claim 1, wherein one or more of the portions comprises a coding circuit.

6. The device of claim 2, wherein the circuit is coupled to the radiative portion and to the impedance matching portion.

7. The device of claim 2, wherein the circuit is coupled to the impedance matching portion.

8. The device of claim 1, wherein one or more of the portions comprises a circuit, and wherein each circuit comprises a different code.

9. A method of using an antenna with an article, comprising the steps of:

coupling the antenna to the article;

providing the antenna with one or more impedance matching portion to match an impedance of the antenna to an impedance of the article;

placing the article in a radiative field;

using the radiative field to excite the antenna to radiate a signal at a resonant frequency; and detecting the signal.

10. The method of claim 9, further comprising the step of providing elements of the antenna in a geometrical relationship that devices a capacitively loaded magnetic dipole antenna.

11. The method of claim 10, further comprising the step of changing a geometrical relationship between some of the elements to change an impedance of the antenna.

12. The method of claim 9, further comprising the step of changing the impedance of the antenna independent of the resonant frequency.

13. The method of claim 9, wherein the article comprises a part of a paper roll.

14. A system comprising:

an article having an article impedance;

an antenna coupled to the article, the antenna having an antenna impedance; the antenna including one or more impedance matching portion arranged to match the antenna impedance to the article impedance and one or more radiative portion;

wherein when the article is placed in a radiative field, the radiative field excites the one or more radiative portion of the antenna to radiate a signal at a resonant frequency.

15. The system of claim 14, wherein the one or more radiative portion are coupled in a first geometric relationship that effectuates the resonant frequency, and wherein the one or more impedance matching portion are coupled in a second geometrical relationship that effectuates the antenna impedance.

16. The system of claim 15, wherein a change in the first geometrical relationship effectuates a change in the resonant frequency.

17. The system of claim 15, wherein a change in the second geometrical relationship effectuates a change in the one or more antenna impedance effectuates a change in the antenna impedance.

18. The system of claim 15, wherein a change in the first geometrical relationship effectuates a change in the resonant frequency, wherein a change in the second geometrical relationship effectuates a change in the one or more antenna impedance effectuates a change in the antenna impedance, and wherein a change of the resonant frequency or the antenna impedance may be effectuated without a corresponding change in the antenna impedance or the resonant frequency.

19. An antenna for coupling to an article, the antenna having an antenna impedance and the article having an article impedance, the antenna comprising:

one or more impedance matching portion arranged to match the antenna impedance to the article impedance;

one or more radiative portion;

wherein when the article if placed in a radiative field, the one or more radiative portion are excited to radiate at a resonant frequency.

20. The antenna of claim 19, wherein the one or more radiative portion are coupled in a first geometric relationship that effectuates the resonant frequency, and wherein the one or more impedance matching portion are coupled in a second geometrical relationship that effectuates the antenna impedance.

21. The antenna of claim 20, wherein a change in the first geometrical relationship effectuates a change in the resonant frequency.

22. The antenna of claim 20, wherein a change in the second geometrical relationship effectuates a change in the one or more antenna impedance effectuates a change in the antenna impedance.

23. The antenna of claim 20, wherein a change in the first geometrical relationship effectuates a change in the resonant frequency, wherein a change in the second geometrical relationship effectuates a change in the one or more antenna impedance effectuates a change in the antenna impedance, and wherein a change of the resonant frequency or the antenna impedance may be effectuated without a corresponding change in the antenna impedance or the resonant frequency.

* * * * *